US008031889B2

(12) United States Patent
Horng et al.

(10) Patent No.: US 8,031,889 B2
(45) Date of Patent: Oct. 4, 2011

(54) ACOUSTOELETRIC TRANSFORMATION CHIP FOR RIBBON MICROPHONE

(75) Inventors: Ray-Hua Horng, Taichung (TW); Chao-Chih Chang, Taichung (TW); Ming-Li Ke, Shengang Shiang (TW); Guan-Wei Chen, Dali (TW); Yao-Cheng Tsai, Tainan (TW)

(73) Assignee: National Chung-Hsing University, Taichung (TW)

( * ) Notice: Subject to any disclaimer, the term of this patent is extended or adjusted under 35 U.S.C. 154(b) by 421 days.

(21) Appl. No.: 12/383,596

(22) Filed: Mar. 24, 2009

(65) Prior Publication Data

US 2009/0245544 A1 Oct. 1, 2009

(30) Foreign Application Priority Data

Mar. 26, 2008 (TW) ..... 97110737 A

(51) Int. Cl.
*H04R 25/00* (2006.01)

(52) U.S. Cl. ..... 381/176; 381/399; 381/401

(58) Field of Classification Search ..... 381/176, 381/177, 184, 185, 355, 398, 399, 401, 423, 381/426

See application file for complete search history.

(56) References Cited

U.S. PATENT DOCUMENTS 7,430,297 B2 * 9/2008 Akino ..... 381/176

* cited by examiner

*Primary Examiner* — Hoai V Pham

(74) *Attorney, Agent, or Firm* — Kilpatrick Townsend & Stockton LLP

(57) ABSTRACT

An acoustoelectric transformation chip for a ribbon microphone includes a diaphragm that has a vibrating region and two fixing regions disposed on two opposite sides of the vibrating region, and a voice coil film formed on the diaphragm. The voice coil film includes two rectangular voice coils, each of which has a plurality of first and second connection segments parallel to a direction of a magnetic field. A plurality of first and second transverse segments are perpendicular to the first and second connection segments and are connected between the first and second connection segments. The second transverse segments of each voice coil are disposed on one of the fixing regions. The first transverse segments of the two voice coils are disposed in the vibrating region.

5 Claims, 5 Drawing Sheets

ACOUSTOELETRIC TRANSFORMATION CHIP FOR RIBBON MICROPHONE

CROSS-REFERENCE TO RELATED APPLICATION

This application claims priority to Taiwanese Application No. 097110737, filed Mar. 26, 2008, the disclosure of which is incorporated herein by reference.

BACKGROUND OF THE INVENTION

1. Field of the Invention

The invention relates to a chip, more particularly to a transformation chip for a ribbon microphone.

2. Description of the Related Art

Conventional acoustoelectric microphones (MICs) are classified into three categories, namely, condenser MICs, piezoelectric MICs, and ribbon MICs.

A condenser MIC is characterized in that a deformable diaphragm vibrated by an external sound wave is a condenser. The change in capacitance of the condenser during vibration is transformed into small voltages corresponding to the sound wave. The small voltages are amplified and outputted as electric signals for subsequent operation of the condenser MIC. A piezoelectric MIC is characterized in that a diaphragm activated by an external sound wave is made of a piezoelectric material such as quartz. The diaphragm deformed by the sound wave can generate voltages by virtue of inherent piezoelectric properties, thus transforming the sound wave into voltage signals for subsequent operations in the piezoelectric MIC.

Referring to FIGS. 1 and 2, a conventional ribbon MIC 1 comprises a housing 11, a set of magnetism devices 12 disposed in the housing 11 to generate a magnetic field along a direction 100, and a diaphragm 13 that can respond to an external sound wave and deform accordingly. A conductive voice coil 14 is disposed on the diaphragm 13 to interact with the magnetic field. When the diaphragm 13 vibrates in response to a sound wave, the voice coils 14 segment magnetic lines of force and thereby generate induced currents as electric signals for subsequent operation. In practice, the larger the number of magnetic lines of force segmented by the voice coils 14, the higher will be the induced current that is generated, and the better will be the sensitivity of the MIC 1. Consequently, the diaphragm 13 and the voice coil 14 are usually designed to have a corrugated configuration.

Acoustoelectric transformation in a ribbon MIC 1 relies on the vibration of the diaphragm 13 in response to the sound-wave that pushes the voice coil 14. Generally, a lighter weight of the diaphragm 13 and a finer size of the voice coil 14 facilitate sensing of weak sound waves and ceasing and repeating movements of the diaphragm 13 and the voice coil 14 within a short time, that is to say, the better the sensitivity of the MIC 1, the better will be the frequency response characteristics.

However, the weights and sizes of the diaphragm 13 and the voice coil 14 are limited by the conventional fabrication process of the conventional ribbon MIC 1, particularly, by mechanical processing steps that produce the diaphragm 13 and the voice coil 14. Therefore, the diaphragm 13 and the voice coil 14 of the conventional ribbon MIC 1 cannot be reduced in weight and size, and the signals generated therefore tend to attenuate at high and low frequencies.

In Taiwanese Publication No. 200845799 and No. 200845800, methods using techniques of semiconductor fabrication and microelectromechanical system (MEMS) to manufacture an acoustoelectric chip package for a ribbon MIC including micro-sized diaphragm and voice coil are proposed. However, since the total length of a voice coil to be displaced in a magnetic field is also an important parameter, there is still a need for increasing the total length of a voice coil for an acoustoelectric chip package of a ribbon MIC.

SUMMARY OF THE INVENTION

Therefore, the object of the present invention is to provide an improved acoustoelectric transformation chip for a ribbon microphone capable of alleviating the above drawbacks of the prior art.

According to the present invention, an acoustoelectric transformation chip mountable within a magnetism device of a ribbon microphone comprises an acoustic response unit including a diaphragm that is made of an insulating material and that has a vibrating region. A fixing region is disposed on two opposite sides of the vibrating region, and a voice coil film made of a conducting material is formed on the diaphragm. The voice coil film includes two rectangular voice coils, each of the voice coils extending rectangularly around an inner end point and connecting to the other one of the voice coils at an outer end point thereof. Each of the voice coils has a plurality of first and second connection segments parallel to a direction of a magnetic field of the magnetism device, and a plurality of first and second transverse segments perpendicular to the first and second connection segments and connected between the first and second connection segments. The second transverse segments of each of the voice coils are disposed on one of the fixing regions. The first transverse segments are spaced-apart from the second transverse segments and are disposed in the vibrating region. A support is attached to the fixing regions of the diaphragm.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
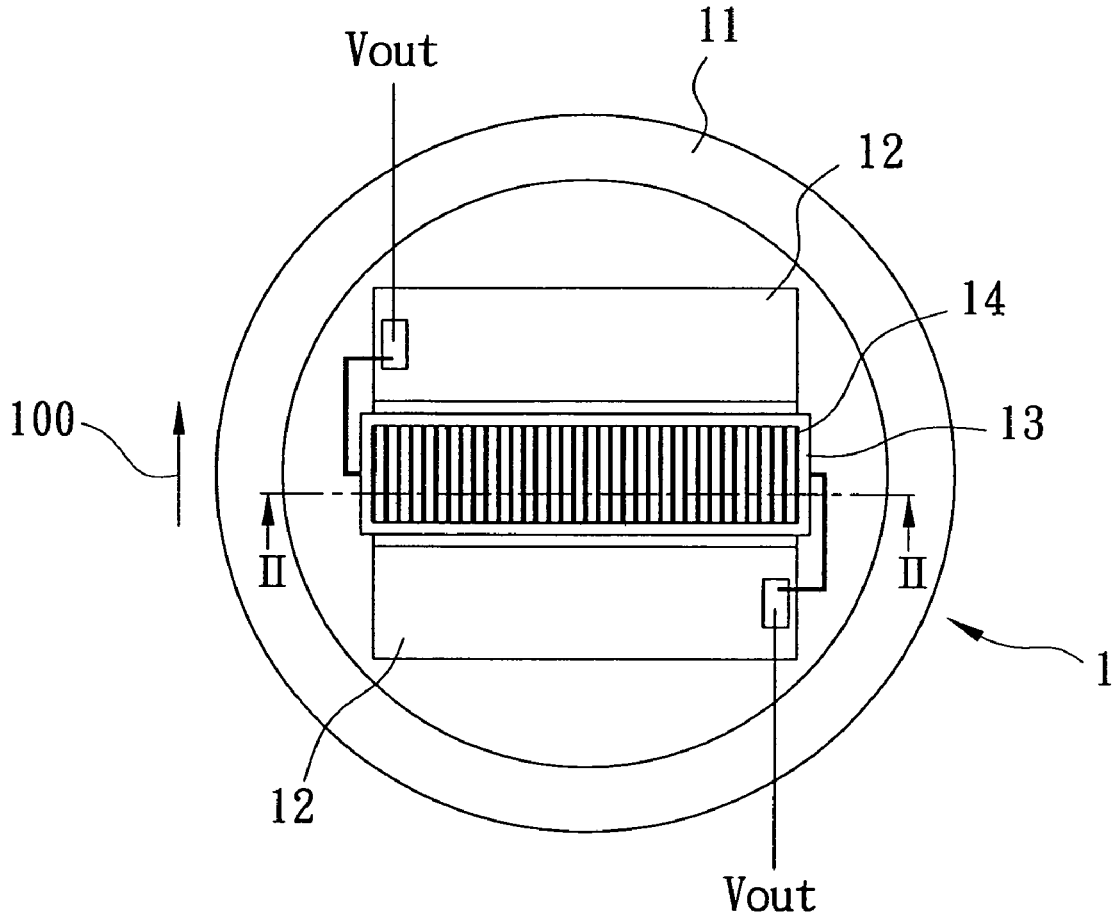
FIG. 1 is a schematic top view of a conventional ribbon microphone.
Figure 2:
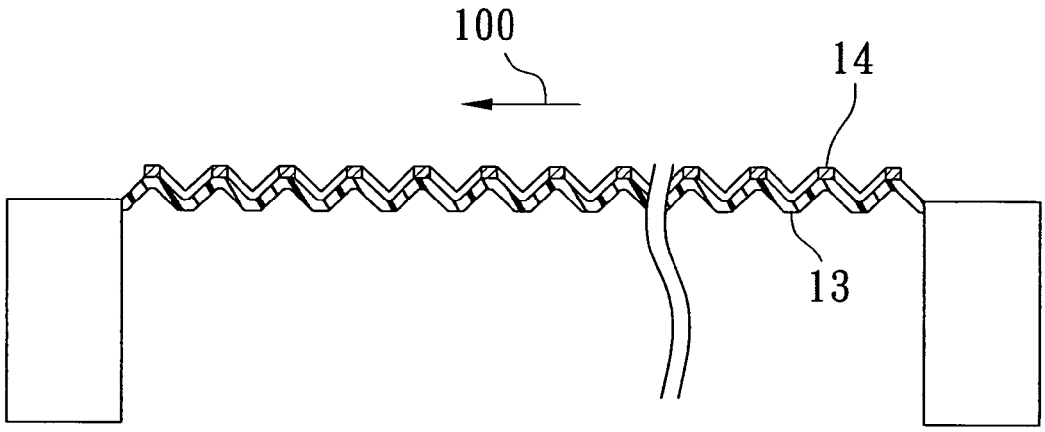
FIG. 2 is a cross-sectional schematic view of the conventional ribbon MIC shown in FIG. 1.
Figure 3:
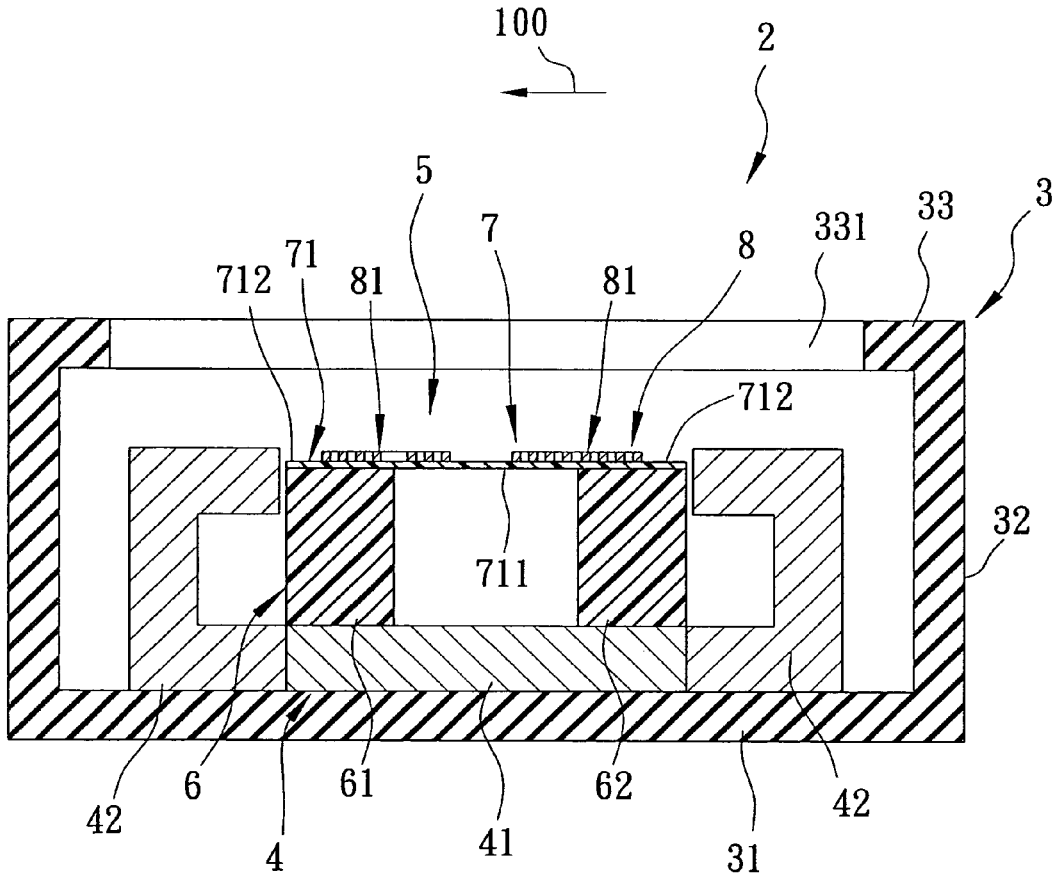
FIG. 3 is a cross-sectional schematic view of a ribbon MIC having an acoustoelectric transformation chip according to a preferred embodiment of the present invention.
Figure 4:
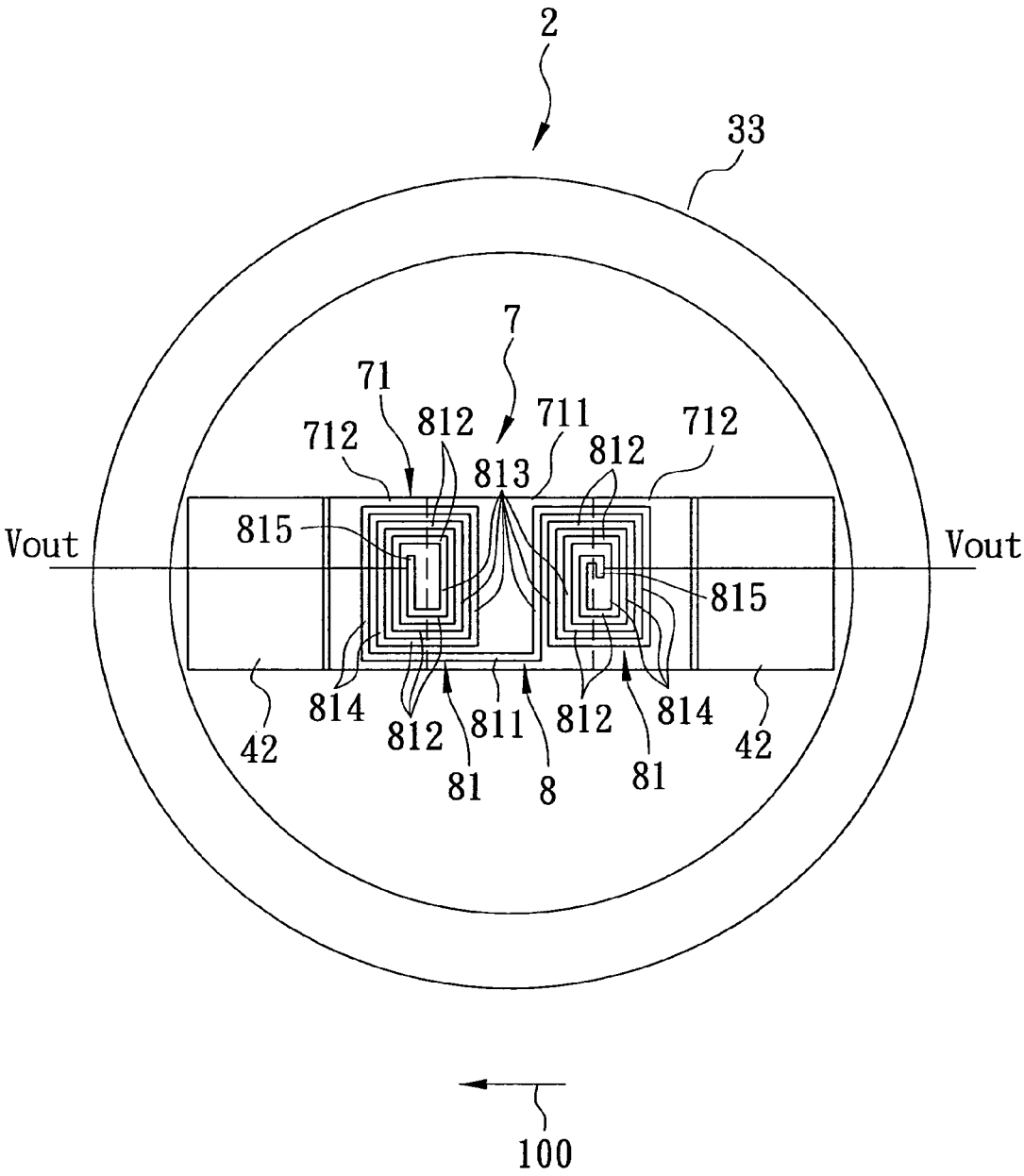
FIG. 4 is a schematic top view of the acoustoelectric transformation chip of FIG. 3.

An acoustoelectric transformation chip 5 according to a preferred embodiment of the present invention is incorporated into a ribbon microphone (MIC) 2 as shown in FIGS. 3 and 4. The acoustoelectric transformation chip 5 is packaged together with a magnetism device 4 in a housing 3 including a base wall 31, a peripheral wall 32 extending from a periphery of the base wall 31, a top wall 33 extending from the peripheral wall 32, and an opening 331 where a cover (not shown) capable of sound transmission is provided.

The magnetism device 4 is disposed in the housing 3 to generate a magnetic field along the direction 100. The magnetism device 4 has a magnet 41 with two opposite magnetic poles, and two spaced-apart magnetic permeation yokes 42 connected to the magnet 41 so as to form the magnetic field. In particular, the magnet 41 is mounted on the base wall 31. The magnetic permeation yokes 42 are substantially U-shaped and are arranged to be mirror-symmetric to each other. The bottom ends of the magnetic permeation yokes 42 are connected respectively to the two magnetic poles of the magnet 41. The magnetic flux of the magnet 41 is guided by the magnetic permeation yokes 42 to form the magnetic field along the direction 100.

The acoustoelectric transformation chip 5 is manufactured by semiconductor and MEMS fabrication techniques and includes a support 6 that has first and second bases 61, 62 disposed on the magnet 41 and proximate to inner sides of the magnetic permeation yokes 42, respectively. The top ends of the first and second bases 61, 62 are substantially at the same level as the top ends of the magnetic permeation yokes 42.

The acoustoelectric transformation chip 5 further includes an acoustic response unit 7 having a thin flat configuration. The acoustic response unit 7 includes a diaphragm 71 that is made of an insulating material, that is supported on the support 6 and that is spaced from the top wall 33. The diaphragm 71 is thus placed within the region of the magnetic field. The diaphragm has a vibrating region 711 that bridges the first and second bases 61, 62, and two fixing regions 712 respectively disposed on two opposite sides of the vibrating region 711. The support 6 is attached to the fixing regions 712 of the diaphragm 7.

The acoustic response unit 7 further includes a voice coil film 8 made of a conducting material and formed on the diaphragm 71. The voice coil film 8 includes two rectangular voice coils 81. Each of the voice coils 81 extends rectangularly around an inner end point 815 and connects to the other one of the voice coils 81 at an outer end point 811 thereof. Each of the voice coils 81 has a plurality of first and second connection segments 812 parallel to the direction 100 of the magnetic field of the magnetism device 4, and a plurality of first and second transverse segments 813, 814 perpendicular to the first and second connection segments 812 and connected between the first and second connection segments 812. The second transverse segments 814 of each of the voice coils 81 are disposed on one of the fixing regions 712, and the first transverse segments 813 are spaced-apart from the second transverse segments 814 and are disposed in the vibrating region 711.

When an external sound wave enters the housing 3 and strikes the vibrating region 711 of the diaphragm 71, the diaphragm 71 vibrates together with the first transverse segments 813 of the two voice coils 81 so that magnetic lines of force of the magnetic field are segmented by the first transverse segments 813, and an induced current is generated. The induced current is outputted as electrical signals corresponding to the sound wave.

Preferably, the diaphragm 71 has a thickness of 1-10 μm and may be made of a material such as silicon nitride, polyimide, parylene or B-staged bisbenzocyclobutene (BCB) monomer. Silicon nitride is used in the preferred embodiment. On the other hand, the voice coil film 8 has a thickness of 1 μm in the preferred embodiment and is formed by electroplating, vapor deposition, or sputtering with the use of a conducting material such as aluminum, cooper, or chromium/gold.

Figure 5:
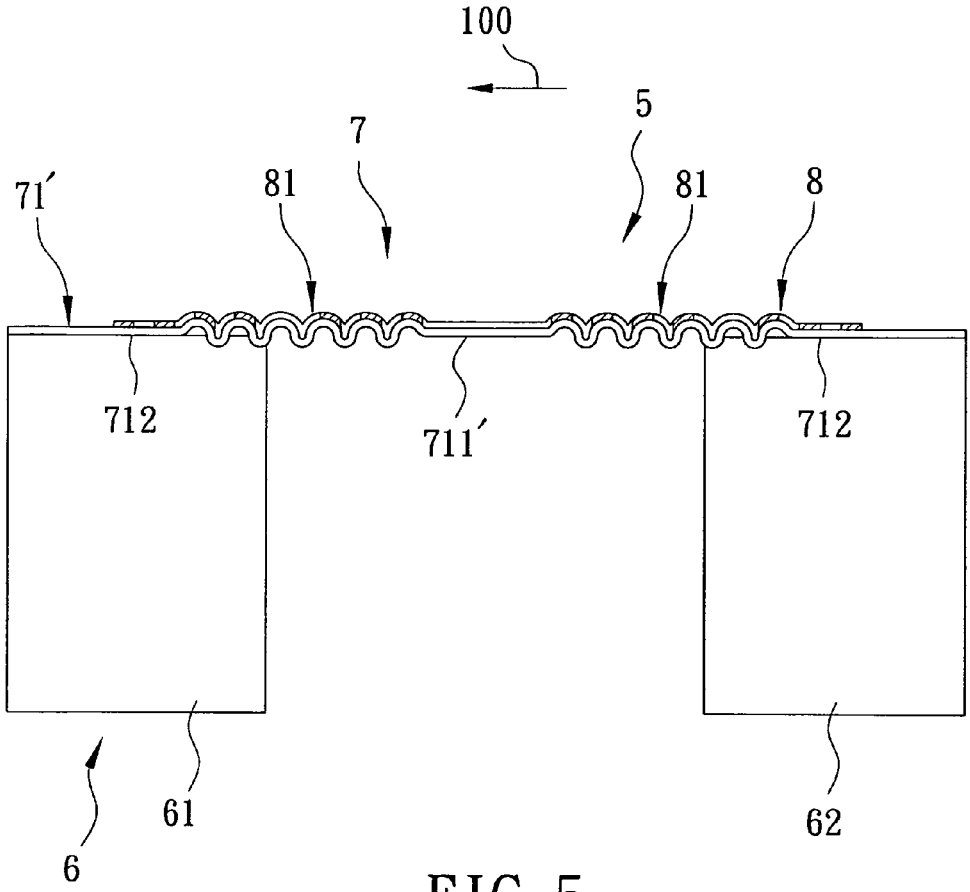
FIG. 5 is a cross-sectional schematic view showing the acoustoelectric transformation chip provided with a corrugated configuration according to another preferred embodiment of the present invention.

It is worth mentioning that the diaphragm used in the invention should not be limited to the flat configuration of the diaphragm 7 shown in FIG. 3. Referring to FIG. 5, in order to improve frequency response characteristics of the ribbon MIC, a vibrating region 711' of the diaphragm 71' is corrugated in another preferred embodiment of the present invention.

According to the present invention, the area of the voice coil film 8 that can vibrate together with the diaphragm 71, 71' is substantially ½ of a total area of the diaphragm 71, 71'. In the ribbon microphone disclosed in Taiwanese Publication No. 200845799, the area of the voice coil film that can vibrate with the diaphragm is ⅓ of a total area of the diaphragm. Therefore, a total length of voice coils that can segment the magnetic lines of force is increased by 50% in the invention compared to that disclosed in the aforementioned prior art, thus improving sensitivity of the acoustoelectric transformation chip and frequency response characteristics of the ribbon MIC 2.

While the present invention has been described in connection with what is considered the most practical and preferred embodiment, it is understood that this invention is not limited to the disclosed preferred embodiments but is intended to cover various arrangements included within the spirit and scope of the broadest interpretation so as to encompass all such modifications and equivalent arrangements.

What is claimed is:

1. An acoustoelectric transformation chip for a ribbon microphone having a magnetism device, comprising:

an acoustic response unit including a diaphragm that is made of an insulating material and that has a vibrating region, and two fixing regions respectively disposed on two opposite sides of said vibrating region, and a voice coil film made of a conducting material and formed on said diaphragm, said voice coil film including two rectangular voice coils, each of said voice coils extending rectangularly around an inner end point and connecting to the other one of said voice coils at an outer end point thereof, each of said voice coils having a plurality of first and second connection segments parallel to a direction of a magnetic field of the magnetism device, and a plurality of first and second transverse segments perpendicular to said first and second connection segments and connected between said first and second connection segments, said second transverse segments of each of said voice coils being disposed on one of said fixing regions, said first transverse segments being spaced-apart from said second transverse segments and being disposed in said vibrating region; and a support attached to said fixing regions of said diaphragm.

2. The acoustoelectric transformation chip of claim 1, wherein said support has a first base and a second base spaced-apart from said first base, said first and second bases being attached to said fixing regions of said diaphragm.

3. The acoustoelectric transformation chip of claim 1, wherein said diaphragm has a thickness of 1-10 μm, and is made of a material selected from silicon nitride, polyimide, parylene, and B-staged bisbenzocyclobutene (BCB) monomers.

4. The acoustoelectric transformation chip of claim 1, wherein said diaphragm is corrugated.

5. The acoustoelectric transformation chip of claim 1, wherein said diaphragm is substantially flat.

* * * * *